United States Patent [19]

Pouderoux et al.

[11] 4,423,770

[45] Jan. 3, 1984

[54] DEVICE FOR REDUCING THERMAL STRESSES ON A HEAT EXCHANGER

[75] Inventors: Pierre Pouderoux, Meudon la Foret; Jean-Pierre Peyrelongue, Pontchartrain, both of France

[73] Assignee: Stein Industrie, Villacoublay, France

[21] Appl. No.: 268,869

[22] Filed: Jun. 1, 1981

[30] Foreign Application Priority Data

Jun. 2, 1980 [FR] France ..... 80 12189

[51] Int. Cl.[3] ..... F28F 9/22

[52] U.S. Cl. ..... 165/134 R; 165/158; 165/174

[58] Field of Search ..... 165/134 R, 158, 174

[56] References Cited

U.S. PATENT DOCUMENTS

| | | | |
|---|---|---|---|
| 1,090,144 | 3/1914 | Guimont | 165/158 |
| 3,908,756 | 9/1975 | Richardson | 165/158 |
| 4,060,127 | 11/1977 | Savin et al. | 165/158 X |

FOREIGN PATENT DOCUMENTS

| | | | |
|---|---|---|---|
| 1233565 | 10/1960 | France | 165/158 |
| 1355565 | 12/1964 | France | 165/158 |
| 2394051 | 1/1979 | France | 165/158 |
| 2444246 | 7/1980 | France | 165/134 R |

*Primary Examiner*—Sheldon J. Richter

*Attorney, Agent, or Firm*—Oblon, Fisher, Spivak, McClelland & Maier

[57] ABSTRACT

Device for reducing thermal stresses on a heat exchanger between two counterflow-circulating liquid alkali metal circuits comprising an annular cylindrical nest of tubes surrounding an axial pipe for the introduction of the liquid alkali metal to be heated and extended by an annular pipe for discharging the heated liquid alkali metal, wherein it comprises in the said annular pipe for discharging the heated liquid alkali metal means for radially homogenizing the temperature of the alkali metal, said means comprising pipes which, at the outlet of the nest of tubes, tap a part of the relatively hotter alkali metal flowing along the outer periphery of the annular pipe to bring it into its flow area closest to the axis.

5 Claims, 3 Drawing Figures

DEVICE FOR REDUCING THERMAL STRESSES ON A HEAT EXCHANGER

The present invention relates to a device for reducing the thermal stresses on a heat exchanger between two counterflow-circulating liquid alkali metal circuits comprising an annular cylindrical nest of tubes surrounding an axial pipe for introducing the liquid alkali metal to be heated and extended by an annular pipe for removing the heated liquid alkali metal.

Heat exchangers of this type used more particularly in stations for producing electric power with fast neutron reactors are exposed to severe stresses at the joint between the outer ferrule and the inner ferrule of the pipe for removing the liquid alkali metal from the exchanger. Such stresses can cause deformations, cracks and even breaks in the aforementioned junction area.

The object of the present invention is to reduce these stresses to a level which is sufficiently low that it no longer presents a danger for the exchanger performance.

The device according to the invention comprises means for radially homogenizing or rendering uniform the temperature of the alkali metal constituted by pipes which sample part of the relatively hotter alkali metal from the periphery of the flow and bring it into the flow area closer to the axis.

The Applicant has found that the thermal stresses observed where due to temperature heterogeneity of the heated liquid alkali metal leaving the tube plate terminating the nest of exchange tubes, the alkali metal temperature increasing radially from the area closest to the pipe for introducing the alkali metal to be heated to the outermost area. This phenomenon can be ignored with the more conventional heat exchange fluids such as water or steam, but is much more important with liquid alkali metals and only the device according to the invention obviates this problem.

Preferably, the present device is also able to satisfy at least one of the following points:

The means for radially homogenizing the temperature of the liquid alkali metal also comprise at the outlet from the said pipes an envelope ensuring over a certain length an outflow of the alkali metal from said pipes in the vicinity of the axial pipe for introducing the alkali metal to be heated.

It also comprises means for removing at least part of the relatively cooler alkali metal from the area closest to the axis.

It also comprises an expansion bellows on the end of a ferrule surrounding the pipe for introducing the alkali metal to be heated which is furthest from the outlet end of the cylindrical nest of tubes.

The bellows is connected to the ferrule by a butt weld.

A device according to the invention is described in exemplified manner hereinafter with reference to the attached drawings, when applied to a heat exchanger between primary sodium from a fast neutron reactor and secondary sodium which is to undergo heat exchange with the water from an electric power station.

Figure 1:
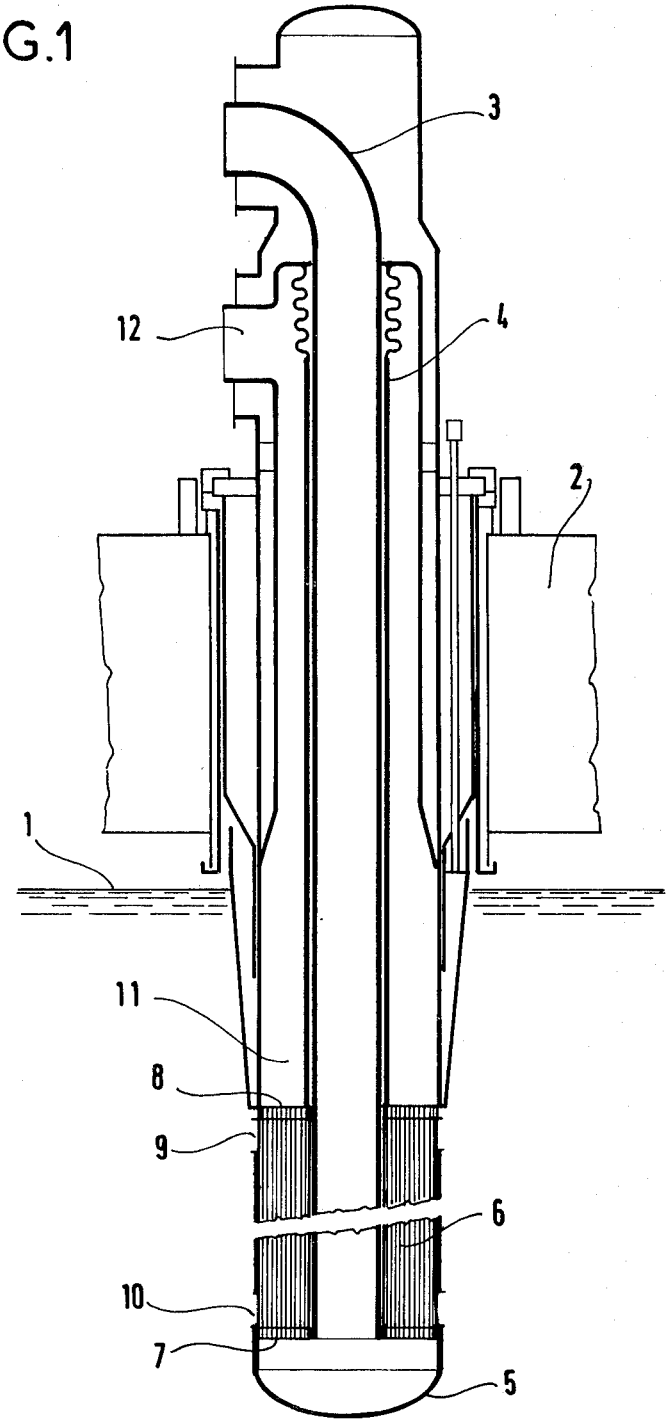
FIG. 1 shows the general construction of the exchanger.

In FIG. 1, the exchanger is immersed in a bath 1 of primary sodium heated in contact with the fast neutron nuclear reactor below the protective slab. A vertical axial pipe 3 is used for introducing the secondary sodium to be heated. This pipe issues into a lower chamber 5 below the annular nest of tubes 6 emanating from a tube plate 7. At the other end, the nest of tubes opens onto the tube plate 8. Inlet 9 and outlet 10 ports make it possible for the primary sodium to circulate around the tubes and in counterflow with respect to the secondary sodium. The heated secondary sodium is discharged by the vertical annular pipe 11 around envelope 4 to the discharge manifold 12.

Figure 2:
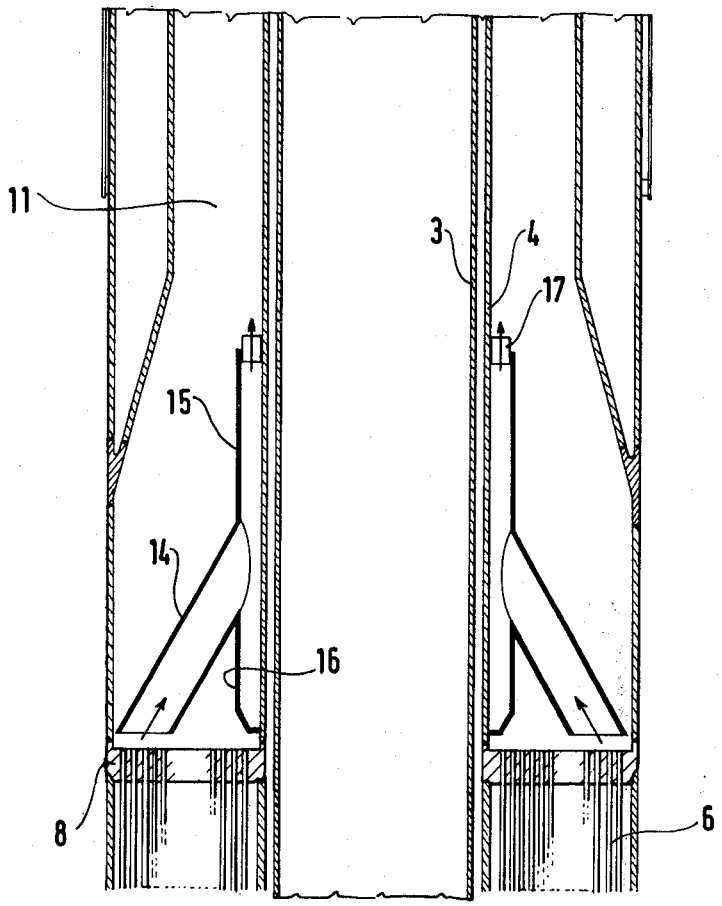
FIG. 2 shows the device for homogenizing the temperature of the heated secondary sodium.

In FIG. 2, it is possible to see the temperature homogenization device constituted by a series of inclined tubes 14, regularly distributed in an angular manner (e.g. 12 tubes at 30° from one another) starting from the periphery of pipe 11 in the vicinity of tube plate 8 and issuing in the vicinity of envelope 4 into an envelope 15 coaxial to envelope 4 and consequently keeping the hottest sodium coming from the periphery in contact over a certain length with the colder sodium of envelope 4. The thus cooled sodium returns to the annular pipe 11 by means of discharge tube 17. The relatively cool sodium from the nest of tubes closest to the cold secondary sodium introduction pipe is spaced from envelope 4 by wall 16.

Figure 3:
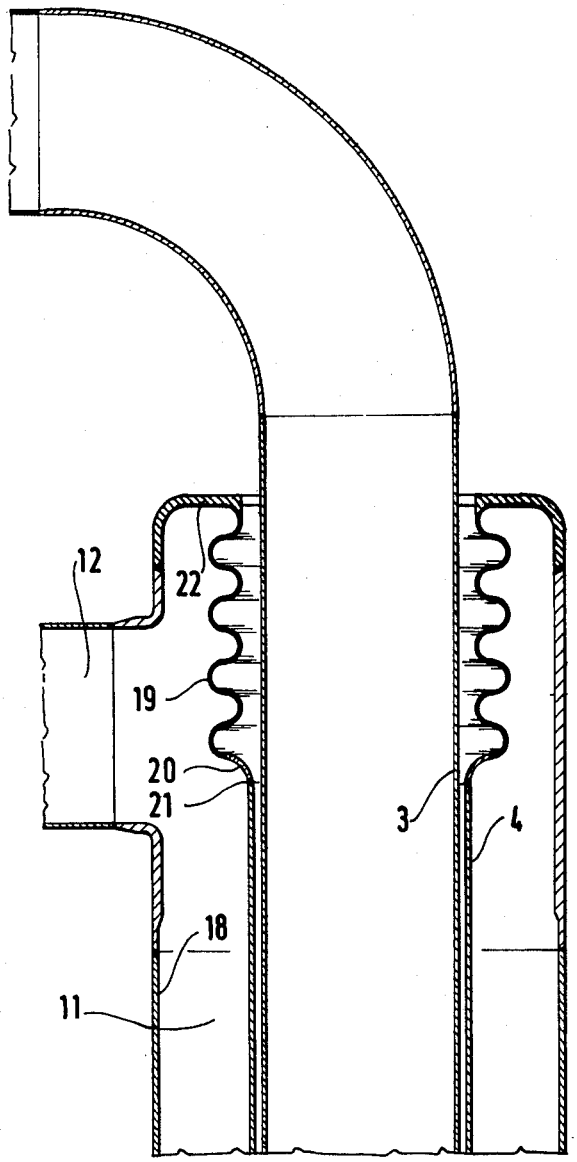
FIG. 3 shows the expansion bellows for absorbing residual thermal stresses.

FIG. 3 shows the expansion bellows for absorbing residual thermal stresses which may remain between the ferrule 18 of the heated secondary sodium discharge pipe and envelope 4. Bellows 19 is butt welded via a circular segment 20 to double envelope 4 at 21. Its upper end is integral with a ring 22 welded to the top of ferrule 18 above the discharge manifold 12. Another, not shown bellows, seals the annular space between pipe 3 and envelope 4.

Although the device for reducing the thermal stresses described hereinbefore with reference to the drawings would appear to be the preferred type it is readily apparent that various modifications can be made thereto without passing beyond the scope of the invention and certain of its components can be replaced by other equivalent components. In particular, the pipes tapping off the hotter liquid alkali metal from the peripheral area to bring it into the vicinity of the pipe for introducing the alkali metal to be heated could be replaced by pipes which tap the alkali metal in the vicinity of said pipe and bring it to the periphery, supplemented by a cylindrical envelope maintaining the cooler alkali metal in the vicinity of the outer ferrule over a certain height.

We claim:

1. A device for reducing thermal stresses on a heat exchanger between two counterflow-circulating liquid alkali metal circuits comprising an annular cylindrical nest of tubes surrounding an axial pipe for the introduction of the liquid alkali metal to be heated and extended by an annular pipe for discharging the heated liquid alkali metal, wherein it comprises in the said annular pipe for discharging the heated liquid alkali metal means for radially homogenizing the temperature of the alkali metal, said means comprising pipes which, at the outlet of the nest of tubes, tap a part of the relatively hotter alkali metal flowing along the outer periphery of the annular pipe to bring it into its flow area closest to the axis.

2. A device according to claim 1, wherein the means for radially homogenizing the temperature of the liquid alkali metal also comprise at the outlet of said pipes an envelope which ensures over a certain length an outflow of the alkali metal coming from the said pipes in the vicinity of the axial pipe for introducing the alkali metal to be heated.

3. A device according to claim 2, wherein it also comprises means for removing at least part of the relatively cooler alkali metal from the area closest to the axis.

4. A device according to any one of the claims 1 to 3, wherein it also comprises an expansion bellows on the end of an envelope surrounding the pipe for introducing the alkali metal to be heated which is furthest from the outlet end of the cylindrical nest of tubes.

5. A device according to claim 4, wherein the bellows is connected to the envelope by a butt weld.

* * * * *